United States Patent [19]

Parkinson et al.

[11] 4,202,503

[45] May 13, 1980

[54] HAMMER MILL

[75] Inventors: Derek Parkinson; Jack Goose, Wakefield, both of England

[73] Assignee: Dresser Europe S.A., Brussels, Belgium

[21] Appl. No.: 903,525

[22] Filed: May 8, 1978

[30] Foreign Application Priority Data

May 9, 1977 [GB] United Kingdom ..... 19429/77

[51] Int. Cl.[2] ..... B02C 13/04

[52] U.S. Cl. ..... 241/194; 241/285 R; 241/285 A; 241/285 B

[58] Field of Search ..... 241/285 B, 285 A, 194, 241/191, 189 R, 189 A, 190, 285 R

[56] References Cited

U.S. PATENT DOCUMENTS

| | | | |
|---|---|---|---|
| 1,420,354 | 6/1922 | Williams | 241/285 B |
| 1,602,622 | 10/1926 | London | 241/285 B |
| 1,847,990 | 3/1932 | Stoner | 241/285 B |
| 2,756,002 | 7/1956 | Brake | 241/285 B |
| 4,009,836 | 3/1977 | Strom et al. | 241/285 B |
| 4,077,574 | 3/1978 | Francis | 241/285 B |

FOREIGN PATENT DOCUMENTS

| | | | |
|---|---|---|---|
| 1022447 | 1/1958 | Fed. Rep. of Germany | 241/194 |

*Primary Examiner*—Richard B. Lazarus

*Attorney, Agent, or Firm*—Larson, Taylor and Hinds

[57] ABSTRACT

A hammer mill comprising a housing and mounted within the housing a rotor and a breaker and screening assembly which cooperates with the rotor is constructed so that the breaker and screening assembly may be angularly displaced between an operative position adjacent the rotor and a servicing position at which access may be had to the breaker and screening assembly from outside the casing.

5 Claims, 5 Drawing Figures

HAMMER MILL

This invention relates to a hammer mill type of crusher or pulveriser for the reduction of coal and similar friable material.

According to the invention, there is provided a hammer mill comprising a housing and mounted within the housing a rotor and a breaker and screening assembly which cooperates with the rotor, wherein the breaker and screening assembly is angularly displaceable between an operative position adjacent the rotor and a servicing position at which access to the breaker and screening assembly be had from outside the casing.

The rotor may be mounted in a main part of the casing and the breaker and screening assembly on a portion of the casing which is pivoted away from and towards the casing main part.

The casing portion may carry means for adjusting the working clearance between the breaker and screening assembly and the rotor.

Preferably the casing has a further portion on the opposite side of the rotor to the breaker and screening assembly which is pivoted to the casing main part and which is pivotal away from the rotor to provide access thereto.

The rotor may be mounted for displacement between a normal operative position and a servicing position nearer to the said further casing portion than the operative position.

The hammer mill may comprise a hammer pin removal mechanism consisting of a sleeve positioned adjacent a rotor end and on the hammer pin circle of the rotor and having a sleeve opening corresponding in size to that of the or each hammer pin bore of the rotor, means for locking the rotor with the or a hammer pin in registry with the sleeve and means for inserting a fresh hammer pin through the sleeve and into the rotor bore to eject the existing hammer pin.

Figure 1:
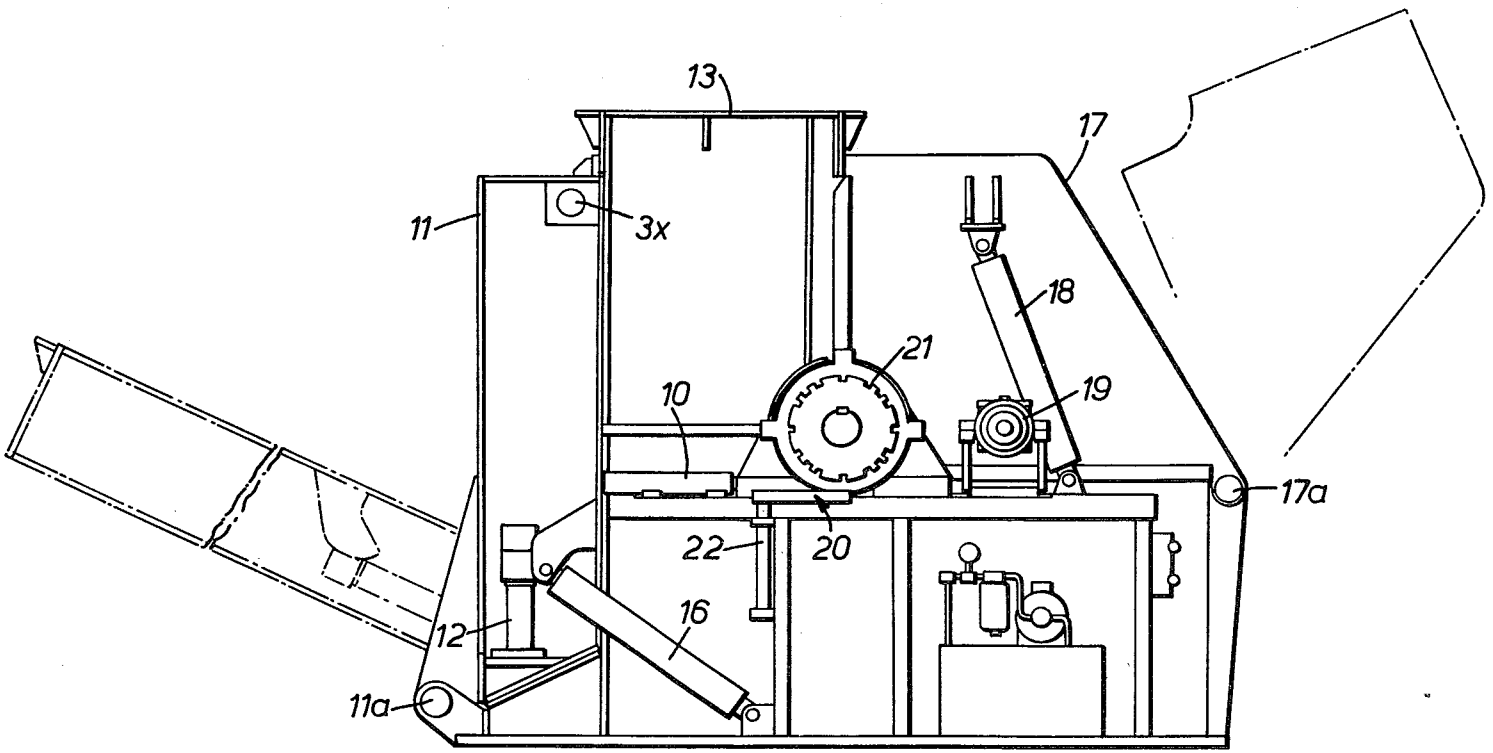
Figure 2:
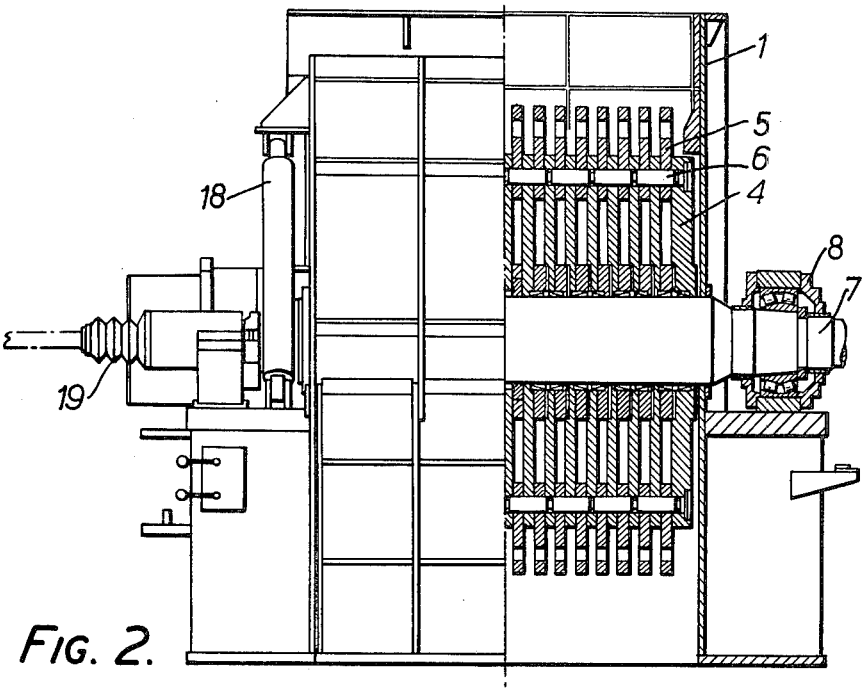
Figure 3:
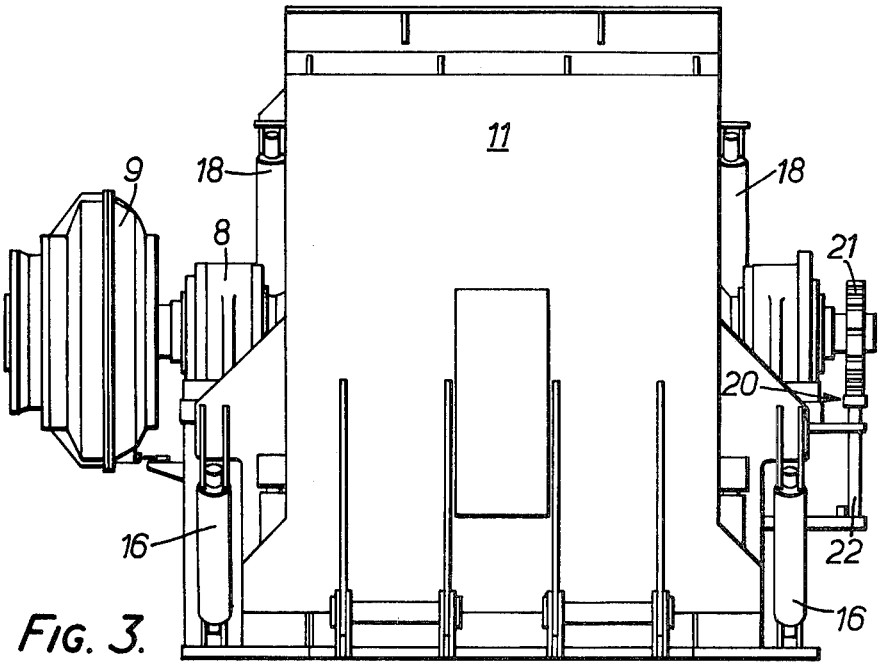
Figure 4:
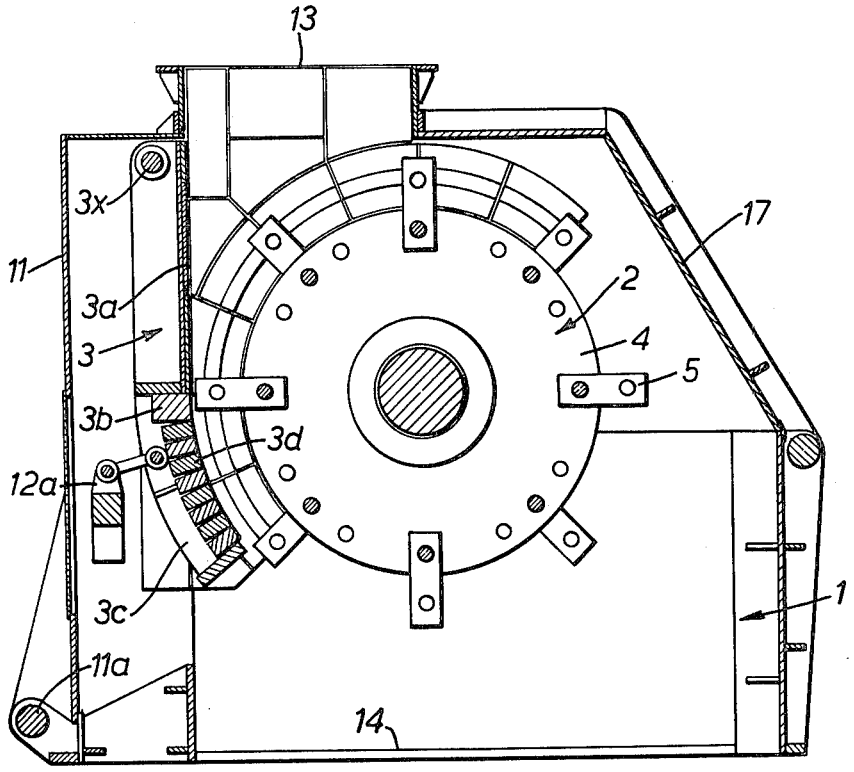
Figure 5:
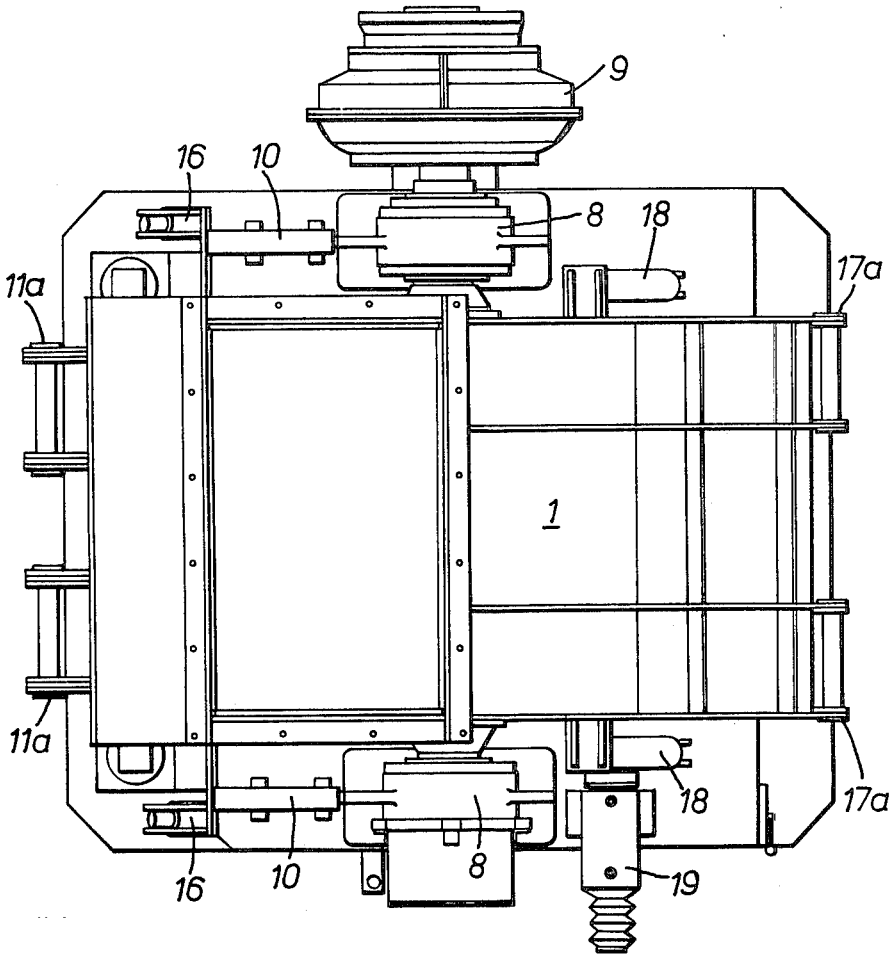

The invention will now be described in greater detail with reference to the accompanying drawings in which, FIG. 1 is a side elevation of a hammer mill type of pulveriser, FIG. 2 is a part section end view of the mill taken from the right hand end as viewed in FIG. 1, FIG. 3 is an outside opposite end view, FIG. 4 is a sectional elevation corresponding to FIG. 1, and FIG. 5 is a plan view of the machine.

Referring to the drawings, the machine comprises a casing 1 having a swing hammer rotor 2 and a breaker and screening assembly 3. The breaker assembly 3 comprises an impact plate **3*a*, a breaker plate 3*b* and a carrier 3*c* for a number of screening bars 3*d*. The rotor consists of a rotor drum 4 carrying a plurality of swing hammers 5 mounted in rows on one of a number of pins 6, and is mounted on a shaft 7 which is supported in bearings 8 and which carries at one end a drive coupling 9. The hammers are preferably coated with a wear resistant deposit e.g. Tungsten Carbide. The rotor and shaft assembly 2, 7 together with the bearing 8, is displaceable by means of two hydraulic cylinders 10 from the operative position shown in FIGS. 4 and 5 towards the right hand end of the casing as viewed in FIG. 1** for a purpose to be described later.

The breaker assembly of which the carrier **3*c* is concentrically curved to match the radius of the hammer tip circle, is pivoted at 3*x* to a door 11 of the casing and is provided with an hydraulic cylinder 12 linked to the breaker plate by a toggle linkage 12*a* for adjusting the clearance between the breaker and screening assembly relative to the rotor 2**. A mechanical adjustment may alternatively be employed. A device is provided to determine the position of the breaker assembly relative to the hammer tip circle and to prevent any physical contact between these parts that would result in damage.

The door 11 is pivoted to the main part of the casing at **11*a* and is provided with two hydraulic cylinders 16 for moving the door about its pivot between the position shown in FIGS. 1 and 4 in which the breaker and screening assembly is in an operative position adjacent the rotor and an open position (shown in broken lines in FIG. 1) in which the assembly 3 is in a servicing position clear of the rotor. In this latter position of the assembly 3 access may be had to the impact plate 3*a*, the breaker plate 3*b* and the screening bars 3*d* from outside the casing 1. It is to be noted that the carrier 3*c*** does not extend beneath the vertical line of the rotor.

The casing has an inlet opening 13 for the material to be pulverised and an outlet opening 14 for the pulverised material. Besides the door 11, the casing has a second door 17 at the opposite end of the machine to the door 11 and again this door is pivoted to the casing structure by means of a pivot **17*a*. Likewise two hydraulic cylinders 18** are provided for opening and closing this latter door.

The machine also incorporates hydraulic hammer pin removal equipment and, referring to FIG. 5, this includes a sleeve housing 19 mounted adjacent one end of the rotor and on the circle of the axes of the hammer pins 6. There are thus a number of angular positions of the rotor (dependent upon the number of rows of hammers) in which the bore of a row of pins aligns with the sleeve opening of the sleeve housing. The size of the sleeve opening corresponds to that of the hammer pin bores of the rotor. In order to lock the rotor in any one of the aforesaid angular positions, a locking device, generally denoted 20, (FIG. 3) is provided. This comprises a toothed wheel 21 on the rotor shaft and normally covered by a shaft end cover not shown and a locking bar 22 which is engageable with the toothed wheel to lock this (and in turn the rotor shaft 7) in position. The bar 22 is readily detachable when not used.

The hammer pin removal equipment further comprises hydraulic mechanism not shown which is operative to insert a fresh pin through the sleeve housing 19 and into the particular pin bore in the rotor.

In normal operation of the machine, the rotor is driven in the anticlockwise direction (as viewed in FIG. 4) and material to be reduced is fed through the opening 14. This material is impacted in free suspension by the hammers 5 which thus effect a primary reduction of the material. The impact plate **3*a* in cooperation with the rotor effects a secondary reduction of this material which is subject to a tertiary reduction by the action of the rotor and the breaker plate 3*b*. Final sizing by attrition is effected by the action of the hammers over the curved screening or grinding area. The breaker assembly is constructed as a sealed unit to minimise the egress of dust. If it is desired to adjust the clearance between the combined impact plate, breaker plate and screening or grinding member and the rotor to vary the product size, this is readily achieved by means of the cylinder 12**.

This clearance is, however, not the only factor which governs the product size (typically 100 mesh and finer), others being hammer profile, distribution of hammers on the rotor and rotor speed. This latter may be achieved by the use of a fluid coupling 9 having "Scoop Control" providing a speed variation of ±10%.

Alternatively a DC Thyristor controlled drive may be adopted providing infinite variation within a range of ±50% of a given normal speed.

Where frequent adjustment of both breaker plate/-hammer tip clearance and speed variation are necessary, this may be arranged by remote control.

In order to provide access to the breaker and screening assembly e.g. for replacement of worn impact and-/or breaker plate elements or worn screening bars, the door 11 may be opened to the dotted line position shown in FIG. 1 by operation of the cylinders 16 which lowers the breaker plate almost to a horizontal position. Access to the rotor on the other hand may be had through the opening provided by the door 17 when this latter is moved into the dotted line position shown also in FIG. 1, by operation of the cylinders 18. With the door in this open position, the rotor assembly may be displaced rearwards towards the door 17 by the cylinder 10 if it is desired to replace the rotor, since in this position, the rotor complete with the shaft 7 may after release of the upper casings of the bearings 8, be lifted clear of the machine through the opening provided by the door 17.

Lastly, if it is desired to replace any one or more of the hammers 5, again the door 17 is opened and the rotor (this time in its normal operating position) is positioned, and then locked by the device 20, with the hammer pin bore in question in registry with the sleeve housing 19. Then by means of the above mentioned mechanism, a new pin is inserted to push the existing pin clear of the hammer to be renewed when the new pin is retracted one hammer thickness to release the hammer in question. Thereafter a fresh hammer may be fitted. Where it is desired to replace more than one hammer in a row, the procedure just described is followed successively, working, of course, to the right in FIG. 1 until all the hammers requiring to be replaced are replaced. The old pin is finally ejected by pushing the new one fully home, when it is only necessary to remove the pin insertion mechanism, release the locking bar 22 and close the door 17 to return the machine to the operative condition.

The hammers 5 may if desired be of the rigidly fixed type.

The combined impact plate, breaker plate and screen or grinding member may if preferred be manufactured in two or more vertical segments each of which may be provided with separate adjusting means to compensate for uneven wear along the length of the rotor.

The machine incorporates devices to detect excessive temperature rises, low oil pressure and/or no oil flow and to stop the flow of feed material and shutdown the mill if necessary.

We claim:

1. A hammer mill comprising a housing including a main part and a door pivoted to the main part for movement between open and closed positions, a rotor mounted in the main housing part, a breaker and screening assembly comprising breaker and screening parts mounted on the door to cooperate with the rotor in the closed position of the door and to provide access to the breaker and screening parts from outside the housing in the open position of the door, means to displace the breaker and screening assembly relative to the door to adjust the working clearance between the breaker and screening assembly and the rotor and means to pivot the door between the open and closed positions.

2. A hammer mill as set forth in claim 1 wherein the means to displace the breaker and screening assembly is operable remotely of the housing.

3. A hammer mill as set forth in claim 1 comprising a hammer pin removal mechanism consisting of a sleeve positioned adjacent a rotor end and on the hammer pin circle of the rotor and having a sleeve opening corresponding in size to that of the or each hammer pin bore of the rotor, means for locking the rotor with the or a hammer pin in registry with the sleeve and means for inserting a fresh hammer pin through the sleeve and into the rotor bore to eject the existing hammer pin.

4. A hammer mill as set forth in claim 1, in which the housing has a second door on the opposite side of the rotor to the breaker and screening assembly which is pivoted to the main housing part and which is pivotal away from the rotor to provide access thereto.

5. A hammer mill as set forth in claim 4 in which the rotor is mounted for displacement between a normal operative position and a servicing position nearer to the second door than the operative position.

* * * * *